US006235459B1

(12) United States Patent
Grace et al.

(10) Patent No.: US 6,235,459 B1
(45) Date of Patent: May 22, 2001

(54) METHOD FOR FORMING AN IMPROVED IMAGING SUPPORT ELEMENT AND ELEMENT FORMED THEREWITH

(75) Inventors: Jeremy M. Grace, Penfield; Louis J. Gerenser, Webster, both of NY (US); Wayne A. Bowman, Medina, OH (US); Elizabeth G. Burns, Windham, NH (US); Richard A. Castle, Webster; David M. Teegarden, Pittsford, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/467,610

(22) Filed: Dec. 20, 1999

(51) Int. Cl.[7] ..... G03C 1/795; G03C 1/81

(52) U.S. Cl. ..... 430/533; 430/534; 428/480; 428/483; 427/393.5

(58) Field of Search ..... 430/523, 532, 430/533, 534; 427/532, 533, 535, 536, 393.5; 428/480, 483

(56) References Cited

U.S. PATENT DOCUMENTS

| | | | |
|---|---|---|---|
| 3,143,421 | 8/1964 | Nadeau et al. | 96/87 |
| 3,201,249 | 8/1965 | Pierce et al. | 96/84 |
| 3,501,301 | 3/1970 | Nadeau et al. | 96/87 |
| 5,418,078 | 5/1995 | Desie et al. | 428/704 |
| 5,425,980 | 6/1995 | Grace et al. | 425/195 |
| 5,457,013 | 10/1995 | Christian et al. | 430/496 |
| 5,563,029 | 10/1996 | Grace et al. | 430/532 |
| 5,723,211 | 3/1998 | Romano et al. | 428/328 |
| 5,726,001 | 3/1998 | Eichorst | 430/523 |
| 5,968,646 * | 10/1999 | Grace et al. | 430/533 |
| 6,037,108 | 3/2000 | Chen et al. | 430/349 |
| 6,071,682 * | 6/2000 | Greener et al. | 430/533 |

OTHER PUBLICATIONS

Research Disclosure, vol. No. 34390, Nov. 1992, pp. 869–874.

Research Disclosure, vol. No. 36230, Jun. 1994, pp. 317–328.

Research Disclosure, vol. No. 36544, Sep. 1994, pp. 501–541.

* cited by examiner

*Primary Examiner*—John Goodrow
(74) *Attorney, Agent, or Firm*—Mark G. Bochetti

(57) ABSTRACT

An imaging support element comprising a polymeric film support and a thermally stable single subbing layer is made by forming a coating over the polymeric film support, the coating having a surface including amine reactive groups in a density of at least $10^{10}$ per $cm^2$ and then heat treating the polymeric film support with the coating thereon at a temperature in the range of from about 50° C. below the glass transition temperature ($T_g$) of the polymeric support up to the glass transition temperature ($T_g$) of the polymeric support. The polymeric film support is nitrogen plasma treated. The layer is preferably formed by coating a monomer solution on the nitrogen plasma treated polymer support wherein the coated monomer has at least two vinyl sulfone groups which provide the amine reactive groups. Alternatively, the layer may be formed by applying to the polymeric support web a coating including at least one non-amine reactive comonomer and at least one comonomer having amine reactive side groups.

22 Claims, 4 Drawing Sheets

METHOD FOR FORMING AN IMPROVED IMAGING SUPPORT ELEMENT AND ELEMENT FORMED THEREWITH

CROSS-REFERENCE TO RELATED APPLICATIONS

The present application is related to U.S. Application Serial Number Docket No. 80347, filed Herewith, by J. Grace et al., and entitled, "METHOD FOR FORMING AN IMPROVED IMAGING SUPPORT ELEMENT INCLUDING AMINE REACTIVE SIDE GROUPS AND ELEMENT FORMED THEREWITH."

FIELD OF THE INVENTION

This invention relates generally to supports for imaging elements, such as photographic, electrostatophotographic and thermal imaging elements, and in particular to supports comprising a polyester polymeric film, an adhesion promoting "subbing" layer, and imaging elements comprising the subbed polymeric film and an image forming layer. More particularly, this invention relates to subbed polymer supports and imaging elements wherein the subbing layer is present on the support during a heat treatment.

BACKGROUND OF THE INVENTION

Imaging elements generally comprise a support, adhesion or tie layers (subbing layers), image recording layers, and auxiliary layers that serve other functions, such as scratch resistance, static abatement, magnetic recording or lubrication. U.S. Pat. No. 6,037,108, titled "THERMALLY STABLE SUBBING LAYER FOR IMAGING ELEMENTS," J. Chen, et al., filed Apr. 27, 1998, discusses the severe requirements for adhesion to the support and between layers in the imaging element. The inert character of most surfaces such as polyester surfaces presents considerable challenge for adhesion of layers coated thereon. As discussed in U.S. Pat. No. 6,037,108, J. Chen, et al., the adhesion difficulties have traditionally been overcome by the use of subbing systems involving etch agents as disclosed in U.S. Pat. No. 3,143,421, titled "ADHERING PHOTOGRAPHIC SUBBING LAYERS TO POLYESTER FILM," by G. Nadeau, et al., Aug. 4, 1964; U.S. Pat. No. 3,201,249, titled "COMPOSITE FILM ELEMENT AND COMPOSITION THEREFOR INCLUDING ANTI-HALATION MATERIAL," by G. Pierce, et al., Aug. 17, 1965, and U.S. Pat. No. 3,501,301, titled "COATING COMPOSITIONS FOR POLYESTER SHEETING AND POLYESTER SHEETING COATED THEREWITH," by G. Nadeau, et al., Mar. 17, 1970, or alternatively, by energetic treatments, including corona discharge, glow discharge (see for example U.S. Pat. No. 5,425,980, titled "USE OF GLOW DISCHARGE TREATMENT TO PROMOTE ADHESION OF AQUEOUS COATS TO SUBSTRATE," by J. Grace et al., Jun. 20, 1995, and references cited therein), ultraviolet radiation, electron beam, and flame treatment. Whether the support is treated by coating with a polymeric subbing layer containing an etchant or whether it is modified by energetic treatment, in many instances an additional subbing layer comprised of gelatin, or a single mixed subbing layer including a non-gelatin polymer and gelatin may be used. These gelatin and mixed subbing layers provide good adhesion to subsequently coated layers comprising hydrophilic colloid binders.

It is also mentioned in U.S. Pat. No. 6,037,108, that recently introduced systems such as the Advanced Photo System™ (APS) require thermal processing of the polyester support. The thermal processing is required in order to meet the mechanical specifications associated with the use of small format film in small cartridges, as well as the film loading and unloading mechanisms employed by APS cameras and APS film processors. The thermal treatment sufficiently reduces the core-set curling tendency of the polymeric film such that the mechanical requirements for the system are met. It is also stated that there are possible manufacturing benefits of coating the subbing layers prior to the requisite heat treatment. However, as disclosed in the above mentioned application, extended heat treatment or annealing processes applied to polyesters with gelatin or mixed subbing layers have been found to severely compromise the adhesion of subsequently coated hydrophilic colloid layers, such as silver halide emulsion layers of silver halide photographic elements.

The thermal degradation of the gelatin-containing subbing may result from thermally driven decomposition of the underlying support and subbing layer(s) and interaction of the byproducts with the gelatin subbing layer. In the case of a single mixed subbing layer, it may result from thermally driven chemical processes involving the non-gelatin polymer and gelatin. Hence, it may be desirable to have a single subbing layer that is both thermally stable and does not contain gelatin.

U.S. Pat. No. 5,563,029, titled "MOLECULAR GRAFTING TO ENERGETICALLY TREATED POLYESTERS TO PROMOTE ADHESION OF GELATIN-CONTAINING LAYERS," by J. Grace et al., Apr. 3, 1995, discloses the use of amine reactive hardeners in combination with nitrogen glow-discharge treatment (or some other means of producing surface amines) applied to polyester support to provide the adhesion function of the subbing system. Grace et al. show that bis(vinylsulfonyl)methane, a representative amine reactive hardener, can be used as a molecular primer to bond a gelatin-containing layer to a plasma-treated support. It is taught that the amine reactive hardener chemically bonds to the plasma-treated support and that the gelatin then bonds to the amine reactive hardener. Similar to its function as a cross linking agent, the hardener links the gelatin to the treated surface by covalent bonds that are established by reaction of the vinylsulfone groups in the hardner with amine groups in the nitrogen-plasma-treated surface and in the gelatin coating. Grace et al. does not suggest that amine reactive hardeners in combination with appropriate surface treatment (e.g., glow discharge) provide a thermally stable subbing layer. In fact, one skilled in the art would likely expect that the highly reactive hardeners disclosed by Grace et al. would undergo undesirable chemical reactions under prolonged exposure to heat (e.g., as required for the manufacture of film base for Advanced Photo System™ film).

SUMMARY OF THE INVENTION

It is therefore an object of the present invention to provide a method for forming an imaging support element which includes a single subbing layer that is thermally stable and does not contain gelatin.

It is a further object of the present invention to provide a method for forming an imaging support element which includes a single subbing layer that retains its adhesion promoting characteristics under the heat treatment conditions required for manufacture of polyester film base, such as that used in the Advanced Photo System™ (APS).

It is an advantage of the present invention that the an imaging support element of the present invention which includes a nitrogen plasma treated polymeric film having an adhesion promoting layer formed thereon and is subjected to a heat treatment exhibits a reduction in the core-set curling tendency of the polymeric film.

Briefly stated, the foregoing and numerous other features, objects and advantages of the present invention will become readily apparent upon a reading of the detailed description, claims and figures set forth herein. These features, objects and advantages for producing an imaging support element are accomplished by forming a coating over a polymeric film support, the coating having a surface including amine reactive groups in a density of at least $10^{10}$ per $cm^2$ and then heat treating the polymeric film support with the coating thereon at a temperature of from about the glass transition temperature ($T_g$) of the polymeric film support minus 50° C. to about glass transition temperature ($T_g$) of the polymeric film. The polymeric fihn support is nitrogen plasma treated. The layer comprises an amine reactive hardener or a chlorine-free non-gelatin polymer with amine reactive side groups. The layer is preferably formed by coating a monomer solution on the nitrogen plasma treated polymer support wherein the coated monomer has at least two vinyl sulfone groups which provide the amine reactive groups. Alternatively, the layer may be formed by applying to the polymeric support web a coating including at least one non-amine reactive comonomer and a comonomer having amine reactive side groups. The coating or subbing layer must not have chlorine-containing, thermally degradable constituents, either chemically bound or mixed in solution. Furthermore, if the coating or subbing layer is used in combination with an underlying chlorine-containing layer, the coating or subbing layer must be chemically stable in the presence of the dehydrohalogenation products of the underlying chlorine-containing layer. The amine-reactive groups must be present in sufficient quantity, preferably in a range of from about $10^{10}$ to about $10^{17}$ sites/$cm^2$, and most preferably, in a range of from about $10^{13}$ to about $10^{15}$ sites/$cm^2$ ) to promote adhesion of the hydrophilic colloid layers. These required amine reactive sites are those which are located at the surface of the coating or layer. The terms "surface" and "at the surface" as used herein is intended to mean and include that portion of the layer or coating within about 2 nm and preferably within about lnm of the top surface of the coating or layer.

In a preferred embodiment of the invention, the polymer film support comprises poly(ethylene naphthalate), the subbing layer comprises an amine-reactive monomer and non-amine-reactive comonomers, wherein the amine reactive monomer provides amine reactive side groups to the polymer formed upon polymerization with the comonomers, and the heat treatment comprises subjecting the subbing layer coated support to a temperature of from about 50° C. below the glass transition temperature ($T_g$) of the polymer support to the glass transition temperature ($T_g$) of the polymer support for a time from 0.1 to 1500 hours. The glass transition temperature ($T_g$) of polyester film supports is, for example, generally in the range of from about 80° C. to about 120° C.

In another embodiment of the present invention, an imaging element for use in an image-forming process is described, the imaging element comprising a subbing layer coated polyester polymeric film support as described above, and an image-forming layer(s) (sometimes referred to as an imaging pack coated on the subbed support).

DETAILED DESCRIPTION OF THE INVENTION

Figure 1:
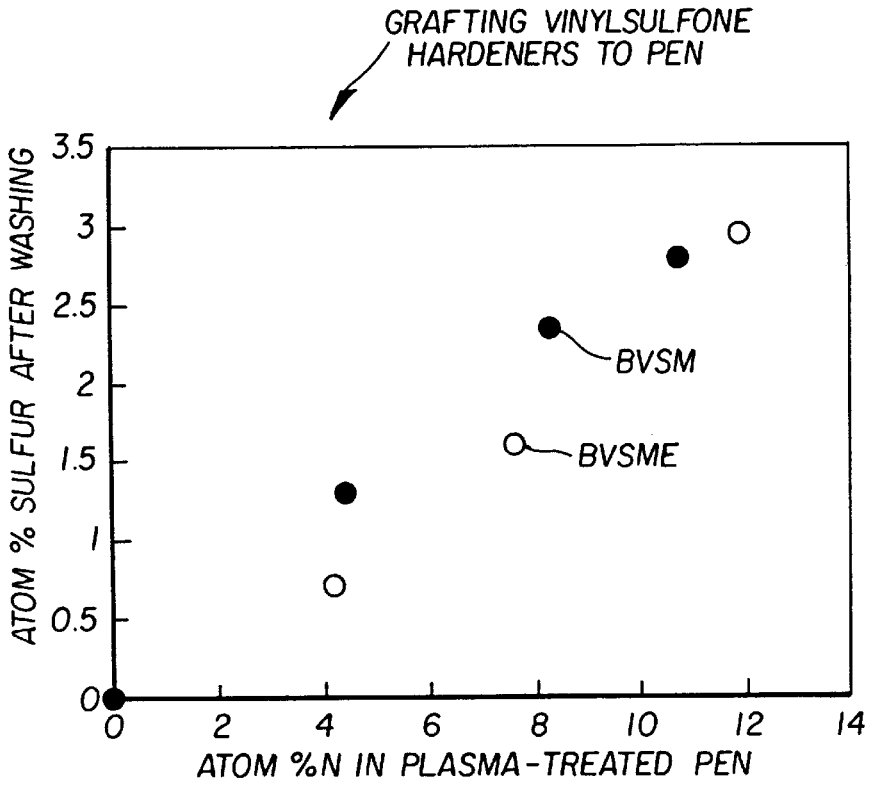
FIG. 1 is a graph of sulfur content of plasma-treated poly(ethylene naphthalate) that has been exposed to a solution of hardener after treatment. The sulfur concentration is plotted as a function of the incorporated nitrogen in the plasma-treated poly(ethylene naphthalate)

In the practice of a preferred embodiment of the method of the present invention, the polymer film comprises poly (ethylene terephthalate) or poly(ethylene naphthalate), the discharge treatment is carried out in a nitrogen plasma, the non-chlorine-containing and non-gelatin-containing subbing component comprises a vinylsulfonyl compound such as described in U.S. Pat. No. 5,723,211, titled "INK-JET PRINTER RECORDING ELEMENT," by C. Romano et al., Mar. 3, 1998, other types of non-halogen-containing amine-reactive hardeners such as described in U.S. Pat. No. 5,418,078, titled "INK RECEIVING LAYERS," by Guido Desie et al., May 23, 1995, or a polymer containing such an amine-reactive functional group, and the heat treatment comprises subjecting the subbing layer coated support to a temperature from about 50° C. below the glass transition temperature ($T_g$) up to the glass transition temperature ($T_g$) of the polymeric film from 0.1 to 1500 hours.

The subbing layer coated supports of the present invention can be used for many different types of imaging elements. While the invention is applicable to a variety of imaging elements such as, for example, photographic, ink jet, electrostatophotographic, photothermographic, migration, electrothermographic, dielectric recording and thermal-dye-transfer imaging elements, the invention is primarily applicable to photographic elements, particularly silver halide photographic elements. Accordingly, for the purpose of describing this invention and for simplicity of expression, photographic elements will be primarily referred to throughout this specification; however, it is to be understood that the invention also applies to other forms of imaging elements.

The annealable (actually heat treatable) subbing formulation does not contain gelatin and does not suffer from the degradation processes driven by acetaldehyde from the polymer base or decomposition products of underlying vinylidene chloride layers, both of which are known to diffuse into a gelatin subbing layer during the annealing process of APS film base.

The subbing formulation can be a monomeric formulation (i.e., a single amine-reactive monomer) or a polymeric formulation in which an amine reactive monomer is polymerized with non-amine reactive comonomers. The monomeric formulation requires that the monomer bond to the polymer support surface (which may be activated by plasma treatment) while having an amine-reactive group available for bonding with subsequently coated layers. This approach is demonstrated in Example 1 below.

The polymeric formulation allows one to dilute the amine reactive monomer with non-amine reactive comonomers to form a polymeric film. The polymeric formulation requires that the amine reactive functionality is available for both anchoring the polymer to the polymer support surface and for bonding with subsequently coated layers. This approach is demonstrated in Examples 2 and 3 below.

With either approach, (monomer or polymer), the essential feature is a surface density of available amine-reactive groups to form bonds with a subsequently coated layer. In the case of the monomer, it is possible to quantify the surface density of functional groups, provided that the monomer has a chemical constituent that is identifiable without interference from elements in the polymeric support (see Example 1).

In the case of the polymeric formulations, however, the non-amine reactive comonomers may have common elements to those in the amine-reactive comonomer and it may be difficult to quantify the net surface density of amine-reactive functional groups. In this case, the formulation variables can be used to quantify the polymer composition, and it can only be assumed that the amine-reactive side groups are present in the surface in proportion to their compositional presence in the polymer formulation.

Examples of amine-reactive hardeners useful in this invention are bis(vinylsulfonyl)methane (BVSM) and other vinylsulfonyl compounds such as described in U.S. Pat. No. 5,723,211, Romano et al. Especially useful are co-and terpolymers incorporating units depicted by:

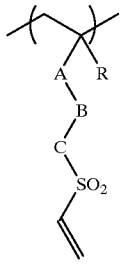

where R is H or $CH_3$,

A is a direct link or is C(O)O or C(O)NH,

B is an aliphatic group of from 1 to 10 carbon atoms, or an aromatic group such as phenyl, benzyl, naphthyl, or pyridinyl, C is a direct link or is an aliphatic group of from 1 to 10 carbon atoms or is chosen from the following structural units:

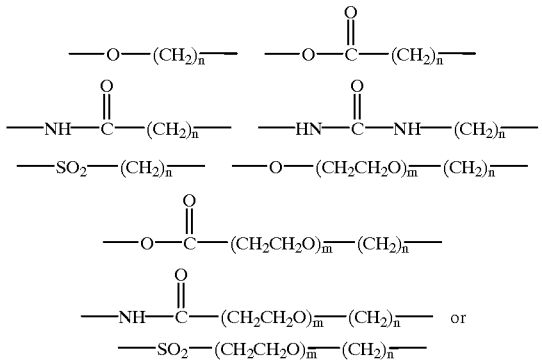

where m and n are separately integers from 0 to 10, and the amine-reactive hardener is polymerized with non-amine reactive comonomers. Non-amine-reactive comonomers useful in this invention are hydrophilic species such as acrylamide, acrylamidoglycolic acid, 2-acrylamido-2-methylpropanesulfonic acid, sodium salt (herein referred to as AMPS), acrylic acid, 4-acryloxybutane-1-sulfonic acid, sodium salt, 2-acryloxyethane-1-sulfonic acid, sodium salt, 3-acryloxypropane-1-sulfonic acid, sodium salt, N,N-dimethylacrylamide, 2-hydroxyethyl acrylate, 2-hydroxyethyl methacrylate, methacrylic acid, 4-methacryloxybutane-1-sulfonic acid, sodium salt, 2-methacryloxyethane-1-sulfonic acid, sodium salt, 3-methacryloxyl-1-methylpropane-1-sulfonic acid, sodium salt, 3-methacryloxypropane-1-sulfonic acid, sodium salt, 1-vinyl-2-pyrrolidinone, or other water-soluble or hydrophilic monomers.

The examples below demonstrate that the combination of nitrogen plasma surface modification and a single subbing layer, the subbing layer comprising amine reactive hardener molecules or polymers having amine-reactive side groups, can withstand the thermal treatment required to condition the polyester support, while retaining the requisite adhesive properties for subsequently coated hydrophilic colloid layers. The amine-reactive groups must be present in sufficient quantity ($10^{10}$ to $10^{17}$ sites/$cm^2$)to promote adhesion of the hydrophilic colloid layers. The lower limit corresponds to a fraction of a monolayer of coverage of the amine-reactive groups, whereas the upper limit corresponds to many layers (roughly 100) of amine-reactive group. Work in our lab correlating adhesion performance of hydrophillic colloid layers on surfaces functionalized with amine-reactive hardeners suggests a preferred surface density range of $10^{13}$ to $10^{15}$ sites/$cm^2$. In the case of bis(vinylsulfonyl)methane (BVSM) grafted to nitrogen-plasma-treated poly(ethylene napthalate) support, this range corresponds to a range of coverage from 0.01 to 1 monolayers of BVSM.

While the surface density of the required amine-reactive groups is the key physical parameter that determines the level of interfacial adhesion, a given surface density of a specific reactive group can be obtained in a variety of ways. If the subbing layer is constructed such that the distribution of desired amine-reactive groups is random and evenly distributed throughout the layer, the preferred range of $10^{13}$ to $10^{15}$ sites/$cm^2$ translates to a particular range of sites per atom in the near-surface region, i.e., within 1 nm of the surface of the subbing layer. Specifically, it has been found that the amine-reactive side groups preferably comprise a ratio of reactive groups per atom in the repeat unit from 0.003 to 0.1. This ratio is defined by taking the number of vinylsulfone groups in a comonomer and dividing it by the total number of atoms in the polymer repeat unit.

In contrast to the random and uniform distribution of reactive groups, layers can be constructed to have a core-shell structure. While the material in the core need not have the reactive groups of interest, the shell may be constructed to have a significant amount of the required reactive groups. In this way, the required surface coverage of reactive sites may be provided with a significantly lower ratio of reactive groups to atoms in the repeat unit or with a significantly lower ratio of reactive groups to atoms in the core-shell structural unit. For these structures, the most appropriate specification is the coverage in sites/$cm^2$ as described above.

While the examples below use a random and uniform distribution of reactive side groups and can thus be specified in terms of ratio of reactive side group to atoms in the repeat unit, it should be apparent to those skilled in the art that alternative ways of constructing the polymeric subbing layer can be found which would provide similar adhesion results with similar amine-reactive sites/$cm^2$ on the subbing layer surface, but with significantly reduced ratios of reactive groups to number of atoms in the subbing structural unit.

Photographic elements which can be provided with a subbing layer in accordance with the invention can differ widely in structure and composition. For example, they can vary greatly in the type of support, the number and composition of image-forming layers, and the kinds of auxiliary layers that are included in the elements. In particular, the photographic elements can be still films, motion picture films, x-ray films, graphic arts films, prints, or microfiche. They can be black-and-white elements or color elements. They may be adapted for use in a negative-positive process or for use in a reversal process.

Polyester film supports which are useful for the present invention include polyester supports such as, poly(ethylene terephthalate), poly(1,4-cyclohexanedimethylene terephthalate), poly(ethylene 1,2-diphenoxyethane-4,4'-dicarboxylate), poly(butylene terephthalate), and poly (ethylene naphthalate) and the like; and blends or laminates thereof with other polymers. Particularly preferred embodiments are poly(ethylene terephthalate) and poly(ethylene naphthalate), and poly(ethylene naphthalate) is especially preferred for use as the support for photographic imaging elements designed for use in the Advanced Photo System™. Preferred polymer film support thickness is less than 400 microns, more preferably less than 200 microns and most preferably less than 150 microns. Practical minimum support thickness is about 50 microns. The supports can either be colorless or colored by the addition of a dye or pigment.

The use of heat processes during conventional polymer film manufacture to modify the physical characteristics of polymer film elements is itself well known. For example, in the continuous manufacture of certain thermoplastic film, particularly polyester film by processes involving extrusion from bulk storage of polymer stock material, it is necessary in order to obtain desired physical properties, such as transparency, tensile strength and dimensional stability, that the usually amorphous, extruded body of film subsequently be heated and worked by prescribed treatments. In such heating and working treatments, the heated film usually is first stretched lengthwise about 2 to 4 times its original length, and then similarly stretched widthwise. The stretching, known as "cold drawing", is carried out at temperatures below the temperature of melting but above the glass transition temperature of the polymer. The resulting film is then described as being biaxially-oriented. The cold drawing effects some change in the crystallinity of the polymer. Next, to enhance the crystallinity and to increase the dimensional stability of the film, the biaxially-oriented polymeric film is "heat-set" by heating it near its crystallization point, while maintaining it under tension. The heating and tensioning also ensure that the heat-set film remains transparent upon cooling. After being directionally oriented and heat-set polymer films are then also conventionally subjected to a subsequent heat treatment known in the art as a "heat-relax" treatment.

The supports of the present invention may optionally be coated with a wide variety of additional fimctional or auxiliary layers such as antistatic layers, abrasion resistant layers, curl control layers, transport control layers, lubricant layers, image recording layers, additional adhesion promoting layers, layers to control water or solvent permeability, and transparent magnetic recording layers. In a preferred embodiment of the invention, the backside of the support (opposite side to which image forming emulsion layers are coated) is coated with an antistatic layer, a transparent magnetic recording layer and an optional lubricant layer. A permeability control layer may also be preferably coated between the antistatic layer and transparent magnetic recording layer. Magnetic layers suitable for use in elements in accordance with the invention include those as described, e.g., in *Research Disclosure*, November 1992, Volume No. 34390. Representative antistatic layers, magnetic recording layers, and lubricant layers are described in U.S. Pat. No. 5,726,001, titled "COMPOSITE SUPPORT FOR IMAGING ELEMENTS COMPRISING AN ELECTRICALLY-CONDUCTIVE LAYER AND POLYURETHANE ADHESION PROMOTING LAYER ON AN ENERGETIC SURFACE-TREATED POLYMERIC FILM," by D. Eichorst, Mar. 10, 1998, the disclosure of which is incorporated herein by reference. It is also specifically contemplated to use supports according to the invention in combination with technology useful in small format film as described in *Research Disclosure*, June 1994, Volume No. 36230. *Research Disclosure* is published by Kenneth Mason Publications, Ltd., Dudley House, 12 North Street, Emsworth, Hampshire P010 7DQ, ENGLAND.

Photographic elements in accordance with the preferred embodiment of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, additional subbing layers, and the like.

In the following discussion of suitable materials for use in the photographic emulsions and elements that can be used in conjunction with the subbed supports of the invention, reference will be made to *Research Disclosure*, September 1994, Volume No. 36544, available as described above, which will be identified hereafter by the term "*Research Disclosure*." The Sections hereafter referred to are Sections of the *Research Disclosure*, Volume No. 36544.

The silver halide emulsions employed in the image-forming layers of photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

In addition to silver halide emulsion image-forming layers, the image-forming layer of imaging elements in accordance with the invention may comprise, e.g., any of the other image forming layers described in U.S. Pat. No. 5,457,013, titled "IMAGING ELEMENT COMPRISING A TRANSPARENT MAGNETIC LAYER AND AN ELECTRICALLY-CONDUCTIVE LAYER CONTAINING PARTICLES OF A METAL ANTIMONATE," by P. Christian et al., Oct. 10, 1995, the disclosure of which is incorporated by reference herein.

The following examples will illustrate the advantages of using the method and adding the materials of the present invention over the use of conventional gelatin subbing layer formulations.

EXAMPLE 1

Pure BVSM

Plasma-treated poly(ethylene-2, 6-naphthalate) (PEN) was prepared by passing the PEN support through a glow-discharge zone in a vacuum web coating machine. A pair of coplanar, water-cooled aluminum electrodes, each 33 cm wide (cross web)×7.6 cm long (along the web direction) were housed in an electrically grounded aluminum enclosure. The 100 $\mu$ thick, 13 cm wide support passed through entrance and exit slits in the side of the enclosure and was thus conveyed 3 cm above the electrodes. The enclosure extended roughly 1 cm behind the support. Treatment gas was admitted to the enclosure through a series of pinholes in one of the cross-web sides of the enclosure. A 40 kHz high voltage supply was used to apply voltage across the coplanar electrodes, which were electrically isolated from the grounded enclosure.

Treatments were carried out in nitrogen at a pressure of 0.10 Torr and a flow of roughly 330 std. cc/min. Web speeds were varied between 3 and 15 m/min and powers were varied between 60 W and 465 W in order to control treatment dose. The treatment dose (in J/cm$^2$) was calculated by multiplying the power and the residence time in seconds (2×[0.076/web speed]×60, where web speed is in m/min.) and dividing by the 500 cm$^2$ area of the pair of electrodes. Resultant doses ranged from 0.07 to 2.8 J/cm$^2$.

Starting solutions of 1.8 wt % bis(vinylsulfonyl)methane (BVSM) in water were further diluted by adding 1.72 g of starting solution to 98.28 g of deionized water. As a subbing layer, the resultant solution (0.03 wt. % BVSM) was coated at 0.27 cc/dm$^2$ onto 13 cm×46 cm sheets, using a #12 wire wound rod from R.D. Specialties. The sheets were placed on a temperature-controlled coating block and were held thereto by suction grooves near the perimeter of the block. The block temperature was 49° C. Coatings were dried on the warm block for several minutes until the bulk of the water was removed and the surfaces appeared to be dry.

Figure 2:
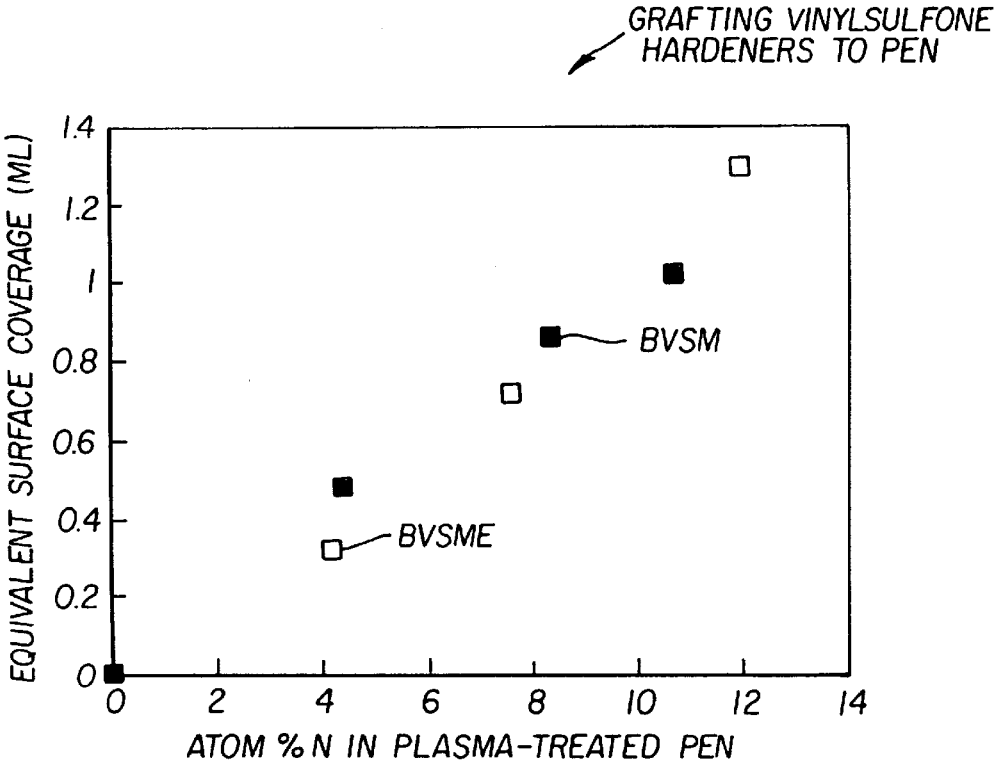
FIG. 2 is a graph of vinylsulfone-based hardener coverage as a function of incorporated nitrogen for plasma-treated poly(ethylene naphthalate) that has been exposed to a solution of hardener after treatment.

In addition, samples of nitrogen-plasma-treated PEN were immersed in solutions of 0.1 wt % bis(vinylsulfonyl)methyl ether (BVSME) in water for 5 minutes at room temperature. They were then dried for 5 min at 40° C. and then washed with deionized water for 1 min and dried in air. A second set of samples was prepared by irmnersing nitrogen-plasma-treated PEN in 0.1 wt % BVSM for 0.5 min at room temperature and then drying the samples for 5 minutes at 93° C. These samples were also washed in deoinized water for 1 min and dried in air. The above mentioned samples were examined using x-ray photoelectron spectroscopy (XPS). The vinylsulfone attachment to the treated surface could be assessed by the amount of sulfur detected. The amount of sulfur could then be converted into an approximate coverage of hardener (in monolayers) by using molecular orbital calculations to determine the size of each type of hardener molecule. One monolayer of BVSM, with one end attached to the support and the other end unreacted, corresponds to $10^{15}$ available reactive groups/cm$^2$. As can be seen in FIGS. 1 and 2, the coverage of BVSM or BVSME increases linearly with nitrogen content of the plasma treated PEN, consistent with increased surface density of amine groups with increasing plasma treatment dose. The XPS studies on the washed samples establish that the vinylsulfone-based hardeners bond with the plasma-treated support. The coating and adhesion experiments described below, as well as the prior work disclosed in U.S. Pat. No. 5,563,029, Grace et al., establishes that a significant amount of the vinylsulfone groups are available for bonding to gelatin-based overcoats. Based on the XPS studies, we establish that the treatment conditions shown in Table 1, in combination with the BVSM coating process, as described above span a BVSM coverage range of <0.1 monolayer to 1 monolayer, or $<10^{14}$ to $10^{15}$ available vinylsulfone groups per cm$^2$. (For sufficiently low treatment doses, there is the additional problem that the BVSM molecule may have both ends bonded to the treated polymer surface, which will further reduce the available groups per cm$^2$. The lower density range of available surface groups is addressed by Example 2 below.)

To simulate heat treatment in a roll format, BVSM-coated sheets of PEN were placed in a pile and were interleaved with clean, untreated sheets of PEN. The stack of coated and uncoated sheets was then placed in an oven at 100° C. for 2 days. A second set of samples was left at room temperature and was not subjected to thermal treatment.

To simulate coating with silver halide emulsion (a hydrophilic colloid layer), the BVSM-coated support was overcoated with the bottom layer of Gold 400 photographic film at a dry coverage of roughly 86 mg/dm$^2$. This layer contained gelatin, dyes, coupler solvents, surfactant and other addenda typical of the bottom layer in Gold 400 film. The layer was coated at 21° C., chill-set for 3:15 at 4° C., dried at 18° C. for 2:40, and further dried at 49° C. for 6:00 (minutes:seconds). After emulsion coating the samples were placed in a stack and were kept in 21° C./50% relative humidity conditions for 10 days in order to allow the emulsion layer to harden.

Practical adhesion was evaluated by use of a mechanical abrasion test in photographic developer. The test was carried out by soaking samples in Flexicolor™ (C-41) developer (at 38° C.) for 3:15 (minutes:seconds). The samples were then placed in a developer-filled tray, and a weighted 35 mm dia. Scotchbrite™ pad from 3M rubbed back and forth along the sample surface (roughly 3 cm stroke) for 30 cycles in roughly 30 sec. The applied weight was 400 g. Samples were rinsed in water and dried. The amount of coating removed in the rubbed area was assessed by use of an optical scanner (Logitech ScanMan), and adhesion failure results were reported as % removed. Typically, scratching from abrasive wear and cohesive failure of the simulated photographic emulsion layer will register as 0 to 5%. Adhesion failure will result in removal above this level, with 10 to 100% removal indicating significant adhesion failure.

The nitrogen discharge treatment conditions and resultant adhesion failure for emulsion coatings on annealed and unannealed subbing are listed in Table 1. The untreated control sample was made by coating the representative hydrophilic colloid layer on untreated and unsubbed PEN support and demonstrates the importance of the subbing layer and surface treatment process.

Samples 1U–5U were coated with BVSM subbing but were not thermally processed prior to coating the representative photographic emulsion (hydrophilic colloid layer). These samples confirm the findings of Grace et al., U.S. Pat. No. 5,563,029, wherein amine reactive hardeners in combination with nitrogen plasma-treated polyesters are found to promote adhesion of subsequently coated hydrophilic colloid layers.

Samples 1A–5A were coated with BVSM subbing and then were thermally treated (annealed) prior to coating the hydrophilic colloid layer. The impact of the annealing process for adhesion of subsequently coated hydrophilic colloid layers is minor (compare results for samples 1U–3U with those for respective annealed samples 1A–3A), and conditions can be found that produce excellent adhesion particularly 4A and 5A). This result is unanticipated, as one skilled in the art might expect the reactive BVSM layer to polymerize or undergo other reactions during the heat treatment process. One would further expect unreacted BVSM to leave the surface by evaporation. At sufficient nitrogen plasma treatment doses, however, good adhesion is obtained even on heat treated, BVSM-coated support.

TABLE 1

Treatment conditions and resultant adhesion for a representative photographic emulsion coated onto BVSM-coated, nitrogen-plasma-treated PEN.

| Sample | Discharge Pressure (mTorr) | Discharge Power (W) | Web Speed (m/min) | Dose ($J/cm_2$) | Adhesion Failure (%) |
|---|---|---|---|---|---|
| 1U | 100 | 60 | 15.2 | 0.072 | 43 |
| 2U | 100 | 120 | 15.2 | 0.144 | 0 |
| 3U | 100 | 160 | 5.06 | 0.578 | 0 |
| 4U | 100 | 330 | 5.06 | 1.19 | 0 |
| 5U | 100 | 465 | 3.05 | 2.79 | 0 |
| 1A | 100 | 60 | 15.2 | 0.072 | 68 |
| 2A | 100 | 120 | 15.2 | 0.144 | 6 |
| 3A | 100 | 160 | 5.06 | 0.578 | 4 |
| 4A | 100 | 330 | 5.06 | 1.19 | 0 |
| 5A | 100 | 465 | 3.05 | 2.79 | 1 |
| Untreated Control | N/A | N/A | N/A | N/A | 100 |

EXAMPLE 2

Polymeric Hardener with Amine-Reactive Side Groups

Plasma treatments were carried out on PEN as discussed in Example 1 above. A terpolymer having 10 wt % acrylamide (A), 80 wt % 2-acrylamido-2-methylpropanesulfonic acid, sodium salt (AMPS), and 10 wt % dehydrohalogenate of 4-acrylamidobenzyl-(2-chloro)ethylsulfone (herein referred to as vinylsulfone-containing monomer, or VSM) was formed by dissolving the appropriate ratio of monomers in a solution of water/acetone (2/1 by weight) to make the final solution 15 wt % in total monomer. This was sparged with nitrogen gas for at least 20 minutes, followed by the addition of $K_2S_2O_8$ (0.1–0.3 wt % based on monomer). The reaction mixture was heated under $N_2$ at 60–65° C. for 16–18 hr, then cooled.

Dehydrohalogenation was effected by adjusting the pH of the polymerization solution to 11 with a dilute NaOH solution, stirring for 30 minutes, and readjusting the pH back to 7 with dilute acetic acid. Solutions were then used as is, or were dialyzed or diafiltered to remove impurities. (Note that the final terpolymer contains no chlorine after dehydrohaleogenation.)

Starting solutions of 1.8 wt % of terpolymer in water were further diluted by adding 1.72 g of starting solution to 98.28 g of deionized water. A second dilute solution was prepared by adding 0.172 g of starting solution to 99.828 g of deionized water. As subbing layers, the resultant solutions (respectively 0.03 wt % and 0.003 wt % terpolymer) were coated onto PEN sheets as described in Example 1.

As in Example 1, heat treatment was carried out by placing subbing-coated sheets of PEN in a pile, interleaved with clean, untreated sheets of PEN. The stack of coated and uncoated sheets was then placed in an oven at 100° C. for 2 days. A second set of samples was left at room temperature and was not subjected to thermal treatment.

Practical adhesion was assessed as described in Example 1. The resultant adhesion data are shown in Table 2. From the table, it can be seen that some combinations of treatment dose and dry coverage of the subbing layer (terpolymer) can be found to produce good adhesion, with or without heat treatment of the subbing coated support (for example, unannealed samples 9U and 14U and their respective annealed samples 9A and 14A). The results do show some sensitivity to dry coverage of terpolymer and treatment dose. At low plasma treatment doses (samples 6U, 6A, 11U and 11A) both annealed and unannealed samples show significant adhesion failure. There is also evidence that excessive treatment doses produce poor adhesion upon annealing (compare results for samples 10U and 10A). Hence, the plasma treatment and subbing layer processes would require some optimization, as one skilled in the art would be able to accomplish.

TABLE 2

Treatment conditions, terpolymer (A-AMPS-VS) coverage, and resultant adhesion for a representative photographic emulsion coated onto terpolymer-coated, nitrogen-plasma-treated PEN.

| Sample | Discharge Pressure (mTorr) | Discharge Power (W) | Web Speed (m/min) | Dose ($J/cm^2$) | Dry Coverage of Terpolymer ($mg/dm^2$) | Adhesion Failure (%) |
|---|---|---|---|---|---|---|
| 6U | 100 | 60 | 15.2 | 0.072 | 0.008 | 69 |
| 7U | 100 | 120 | 15.2 | 0.144 | 0.008 | 0 |
| 8U | 100 | 160 | 5.06 | 0.578 | 0.008 | 1 |
| 9U | 100 | 330 | 5.06 | 1.19 | 0.008 | 2 |
| 10U | 100 | 465 | 3.05 | 2.79 | 0.008 | 4 |
| 6A | 100 | 60 | 15.2 | 0.072 | 0.008 | 59 |
| 7A | 100 | 120 | 15.2 | 0.144 | 0.008 | 8 |
| 9A | 100 | 330 | 5.06 | 1.19 | 0.008 | 0 |

TABLE 2-continued

Treatment conditions, terpolymer (A-AMPS-VS) coverage, and resultant adhesion for a representative photographic emulsion coated onto terpolymer-coated, nitrogen-plasma-treated PEN.

| Sample | Discharge Pressure (mTorr) | Discharge Power (W) | Web Speed (m/min) | Dose (J/cm$^2$) | Dry Coverage of Terpolymer (mg/dm$^2$) | Adhesion Failure (%) |
|---|---|---|---|---|---|---|
| 10A | 100 | 465 | 3.05 | 2.79 | 0.008 | 33 |
| 11U | 100 | 60 | 15.2 | 0.072 | 0.08 | 57 |
| 12U | 100 | 120 | 15.2 | 0.144 | 0.08 | 18 |
| 13U | 100 | 160 | 5.06 | 0.578 | 0.08 | 8 |
| 14U | 100 | 330 | 5.06 | 1.19 | 0.08 | 5 |
| 11A | 100 | 60 | 15.2 | 0.072 | 0.08 | 11 |
| 12A | 100 | 120 | 15.2 | 0.144 | 0.08 | 0 |
| 14A | 100 | 330 | 5.06 | 1.19 | 0.08 | 0 |

EXAMPLE 3

Varying the Polymeric Hardener Composition

Plasma treatments were carried out on PEN as discussed in Example 1. Terpolymers having acrylamide (herein referred to as A), 2-acrylamido-2-methylpropanesulfonic acid, sodium salt (herein referred to as AMPS), and dehydrohalogenate of 4-acrylamidobenzyl-(2-chloro) ethylsulfone (the vinylsulfone-containing monomer, or VSM). As before, note that the final terpolymer contains no chlorine after dehydrohaleogenation. In addition, copolymers of 2-acrylamido-2-methylpropanesulfonic acid, sodium salt, and dehydrohalogenate of 4-acrylamidobenzyl-(2-chloro)ethylsulfone were prepared. For the terpolymer and the binary copolymer, the molar percentage of dehydrohalogenate of 4-acrylamidobenzyl-(2-chloro) ethylsulfone ranged from 7 to 25. The various terpolymers and copolymers used are listed in Table 3.

To form the terpolymers and copolymers, the appropriate ratio of monomers was dissolved in a solution of water/acetone (2/1 by weight) to make the final solution 15 wt % in total monomer. This was sparged with nitrogen gas for at least 20 minutes, followed by the addition of $K_2S_2O_8$ (0.1–0.3 wt % based on monomer). The reaction mixture was heated under $N_2$ at 60–65° C. for 16–18 hours, then cooled.

Dehydrohalogenation was effected by adjusting the pH of the polymerization solution to 11 with a dilute NaOH solution, stirring for 30 minutes, and readjusting the pH back to 7 with dilute acetic acid. Solutions were then used as is, or were dialyzed or diafiltered to remove impurities.

TABLE 3

Terpolymer and copolymer compositions applied to nitrogen plasma-treated PEN. The vinylsulfone ratio is the number of vinylsulfone groups divided by the total number of atoms in the repeat unit of the polymer.

| Polymer | Mole % | | | Weight % | | | Vinylsulfone |
|---|---|---|---|---|---|---|---|
| ID | A | AMPS | VSM | A | AMPS | VSM | Ratio |
| TER-7 | 27 | 66 | 7 | 10 | 80 | 10 | 0.0031 |
| TER-17 | 23 | 60 | 17 | 8 | 68 | 24 | 0.0072 |
| TER-25 | 19 | 56 | 25 | 6 | 60 | 34 | 0.0102 |
| CO-9 | 0 | 91 | 9 | 0 | 89 | 11 | 0.0033 |
| CO-17 | 0 | 83 | 17 | 0 | 79 | 21 | 0.0062 |

Dilute solutions of the terpolymers and copolymers were coated on the plasma-treated support at a wet coverage of 0.27 cc/dm$^2$. For TER-8 polymer, two different dilutions (using de-ionized water) were prepared to obtain dry coverages of 0.083 and 0.83 mg/dm$^2$. For the other four polymers, only samples having dry coverages of 0.083 mg/dm$^2$ were prepared. The polymer layers were coated at a line speed of 9 m/min. and were dried at 93° C. in an in-line dryer section. At the stated coating speed, the residence time in the dryer was 4:10 (minutes:seconds). No surfactant was added to the coatings, except for the case of TER-17 coated on PEN with the high plasma treatment dose (2.79 J/cm$^2$). In that case, the surfactant used was Olin 10-G.

Heat treatment was carried out by placing 3 m lengths of each coating onto a composite roll attached to a 7.6 cm diameter cardboard core. The wound roll was then placed in an oven and kept at 110° C. for 3 days and then 100° C. for 2 days. A second composite roll was prepared and left at room temperature and was not subjected to thermal treatment. Both of these rolls were then overcoated with a representative hydrophilic colloid layer (the same formulation as was used in Examples 1 and 2). In this example, the representative photographic emulsion was coated by extrusion hopper on a machine at a line speed of 3.7 m/min, with respective chill set, first dryer, and second dryer temperatures of 4° C., 21° C., and 38° C., for respective times of 3:15, 2:40, and 3:10 (minutes:seconds).

Figure 3:
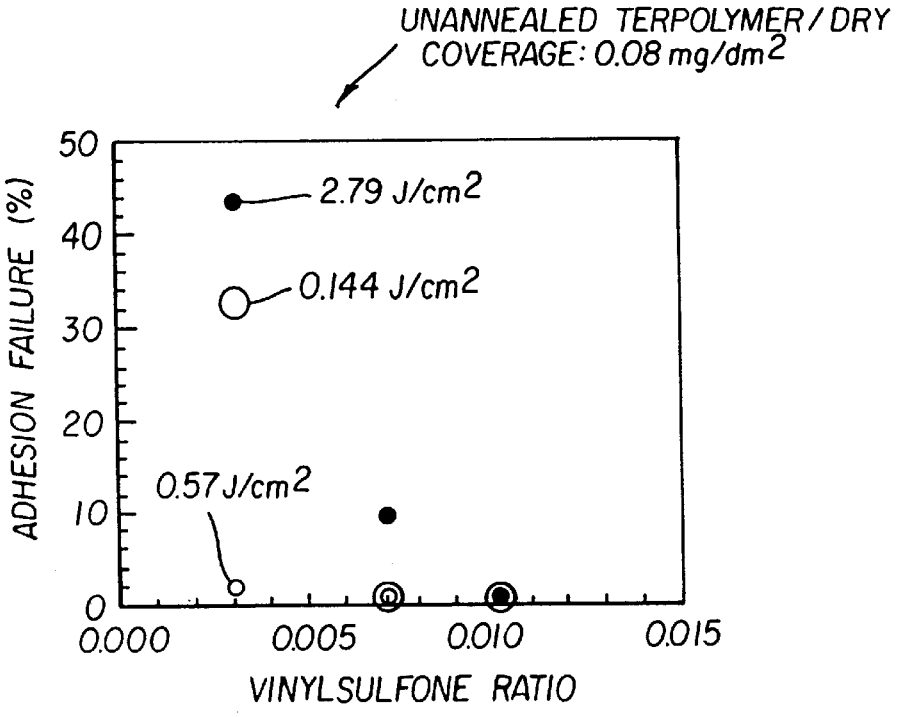
FIG. 3 is a graph plotting adhesion failure as a function of composition of a subbing layer (concentration of vinylsulfone group on an atomic basis) for a terpolymer subbing layer coated support which was not heat treated prior to emulsion coating.
Figure 4:
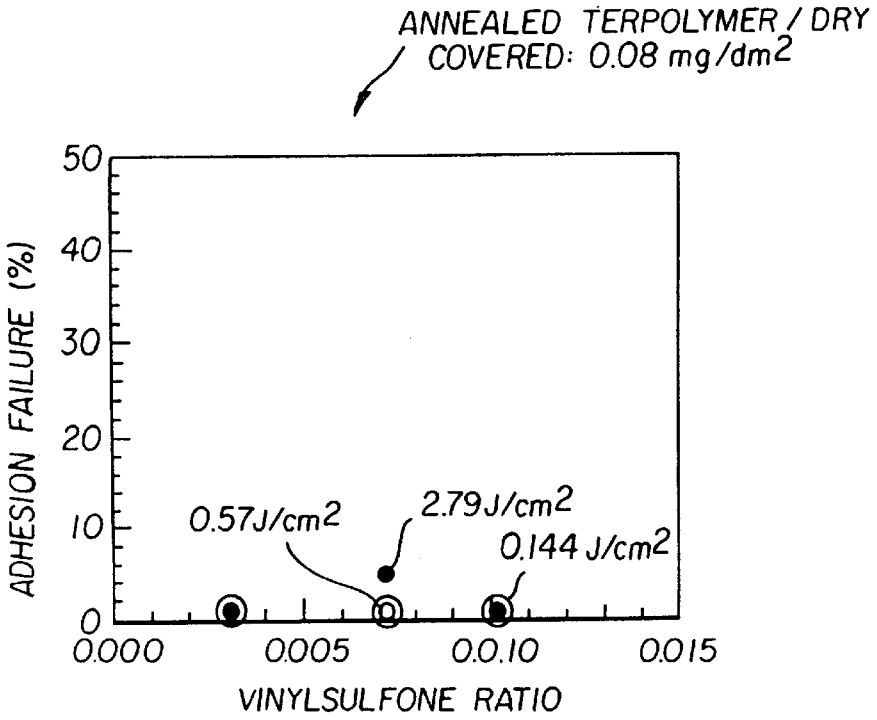
FIG. 4 is a graph plotting adhesion failure as a function of composition of a subbing layer (concentration of vinylsulfone group on an atomic basis) for a terpolymer subbing layer coated support which was heat treated prior to emulsion coating.
Figure 5:
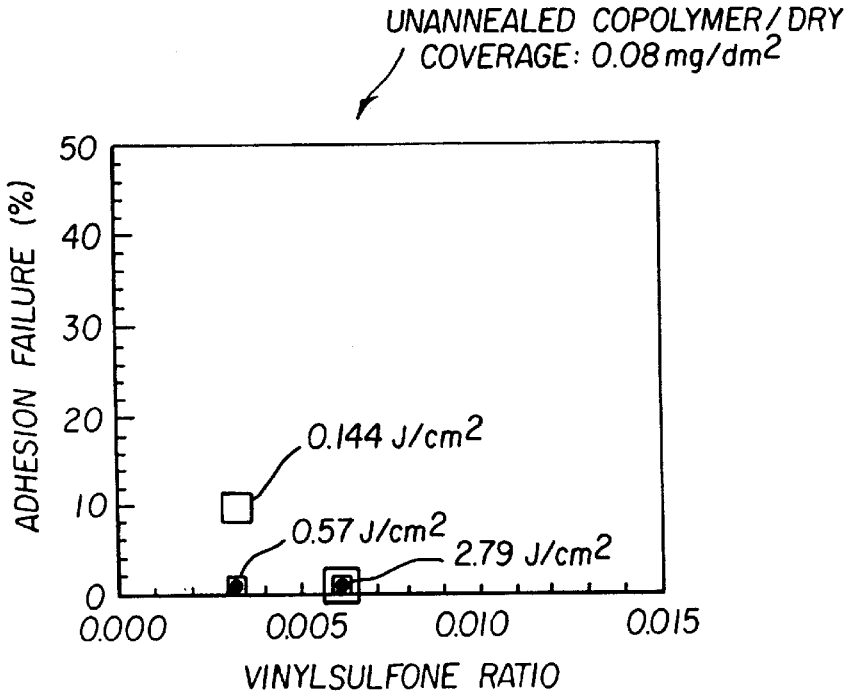
FIG. 5 is a graph plotting adhesion failure as a function of composition of a subbing layer (concentration of vinylsulfone group on an atomic basis) for a copolymer subbing layer coated support which was not heat treated prior to emulsion coating.
Figure 6:
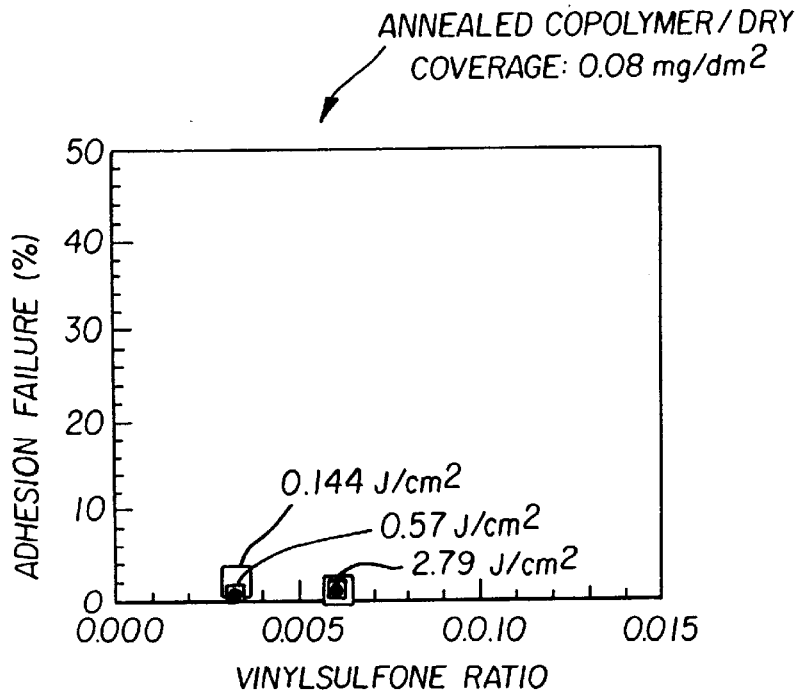
FIG. 6 is a graph plotting adhesion failure as a function of composition of a subbing layer (concentration of vinylsulfone group on an atomic basis) for a copolymer subbing layer coated support which was heat treated prior to emulsion coating.
Figure 7:
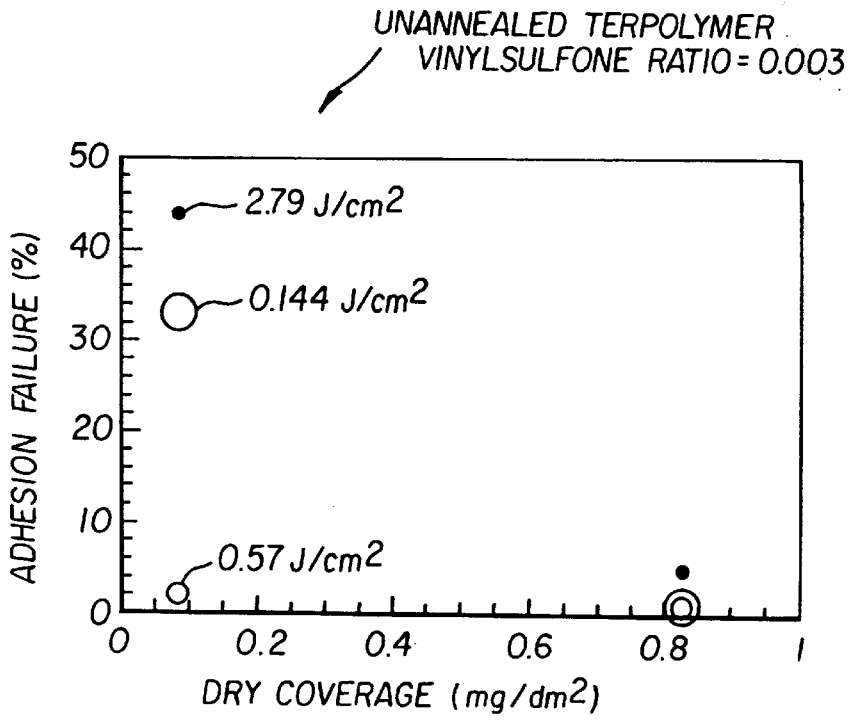
FIG. 7 is a graph plotting of adhesion failure as a function of terpolymer subbing layer coverage wherein the subbing coated support was not heat treated prior to an emulsion coating simulation.
Figure 8:
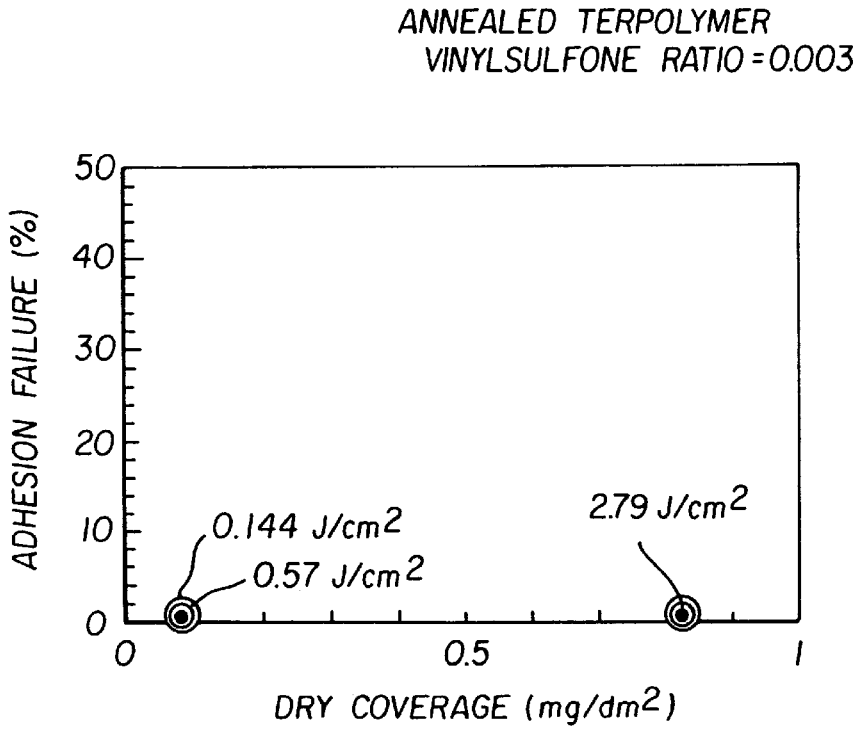
FIG. 8 is a graph plotting of adhesion failure as a function of terpolymer subbing layer coverage wherein the subbing coated support was heat treated prior to an emulsion coating simulation.

As in Examples 1 and 2, wet adhesion failure was assessed after the samples were kept for 10 days in 21° C./50% relative humidity conditions. The adhesion failure results are plotted in FIGS. 1–6. FIGS. 1 and 2 show respective adhesion failure without and with heat treatment for the TER series with three different nitrogen plasma treatment doses. FIGS. 3 and 4 show respective adhesion failure without and with heat treatment for the CO series with three different nitrogen plasma treatment doses. FIGS. 5 and 6 show respective adhesion failure without and with heat treatment for the TER-8 polymer at two dry coverages with three different nitrogen plasma treatment doses.

From the graphs, (FIGS. 1–8) and data presented therein, the following results are evident. First, heat treatment of the polymeric subbing layer generally improves adhesion performance. Second, increasing the vinylsulfone ratio from 0.003 to 0.007 or 0.010 generally improves the adhesion performance. Third, at a sub-optimal vinylsulfone ratio fraction of 0.003, increasing the dry coverage from 0.083 to 0.83 mg/dm$^2$ improves the adhesion performance. In addition, at the same sub-optimal vinylsulfone ratio, the plasma treatment dose can be adjusted to obtain acceptable adhesion with or without heat treatment. Furthermore, the most robust adhesion with respect to plasma treatment dose, subbing layer coverage and heat treatment is obtained for vinylsulfone ratios above 0.003. (This example suggests that the composition of terpolymer used in Example 2—vinylsulfone ratio of 0.003—is sub-optimal, but could be coated sufficiently thick on an appropriately treated support to produce good adhesion before or after heat treatment, consistent with the conclusions drawn from Example 2). Finally, the nature of the polymer backbone is not important, provided it is stable at the requisite processing temperatures.

The enhanced adhesion subsequent to heat treatment suggests that the dominant thermally driven chemical processes involve linking polymer chains in the subbing layer to the treated support surface or to other polymer chains in the subbing layer, without compromising the availability of reactive groups at the subbing surface. These reactive groups (from the vinylsulfone side group) are essential for adhesion of the hydrophilic colloid layer coated to the subbing layer. This surprising result demonstrates that the objectives of this invention (i.e., the above mentioned objectives hinging upon a thermally stable chlorine-free, gelatin-free subbing layer) can be met by use of polymeric hardeners with vinylsulfone ratio of 0.003 or higher, or by providing an equivalent surface density of reactive groups.

The many features and advantages of the invention are apparent from the detailed specification and thus it is intended by the appended claims to cover all such features and advantages which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

The invention has been described in detail with particular reference to certain preferred embodiments thereof, but it will be understood that variations and modifications can be effected within the spirit and scope of the invention.

What is claimed is:

1. A method for producing a photographic film element comprising the steps of:

(a) forming a layer over a polymeric support, the layer having a surface including amine reactive groups in a density of at least $10^{10}$ sites per $cm^2$;

(b) heat treating the polymeric support with the layer thereon at a temperature of from about 50° C. below the glass transition temperature ($T_g$) of the polymeric support up to the glass transition temperature ($T_g$) of the polymeric support; and (c) coating the surface having amine reactive groups thereon with an imaging pack wherein at least a bottom layer thereof includes an amine containing hydrophilic colloid binder which reacts with the amine reactive groups the layer.

2. A method for producing an imaging support element comprising the steps of:

(a) forming a coating over a polymeric film support, the coating having a surface including amine reactive groups in a density of at least $10^{10}$ sites per $cm^2$; and (b) heat treating the polymeric film support with the coating thereon at a temperature of from about 50° C. below the glass transition temperature ($T_g$) of the polymeric support up to the glass transition temperature ($T_g$) of the polymeric support.

3. A method is recited in claim 1 wherein said forming step is performed by:

(a) nitrogen plasma treating the polymer support;

(b) coating a monomer solution on the nitrogen plasma treated polymer support wherein the coated monomer has at least two vinyl sulfone groups which provide the amine reactive groups; and (c) drying the monomer solution on the polymer support.

4. A method is recited in claim 2 wherein said forming step is performed by:

(a) nitrogen plasma treating the polymer support;

(b) coating a monomer solution on the nitrogen plasma treated polymer support wherein the coated monomer has at least two vinyl sulfone groups which provide the amine reactive groups; and (c) drying the monomer solution on the polymer support.

5. A method as recited in claim 3 wherein:

the coated monomer is bis(vinylsulfonyl)methane (BVSM).

6. A method as recited in claim 3 wherein:

the coated monomer is bis(vinylsulfonyl)methyl ether (BVSME).

7. The method as recited in claim 2 wherein:

said heat treating step is performed at a temperature of from about 70° C. to about 120° C.

8. The method as recited in claim 1 wherein:

said heat treating step is performed at a temperature of from about 70° C. to about 120° C.

9. A method as recited in claim 1 wherein:

the amine reactive group is a moiety of a vinylsulfonyl compound.

10. A method as recited in claim 1 wherein:

the amine reactive groups are at the surface of the layer in a density range of from $10^{13}$ sites per $cm^2$ to $10^{15}$ sites per $cm^2$.

11. A method as recited in claim 3 wherein:

said nitrogen plasma treating step is performed at a treatment dose in a range from about 0.1 to about 1.2 Joules/$cm^2$.

12. A method as recited in claim 4 wherein:

said nitrogen plasma treating step is performed at a treatment dose in a range from about 0.1 to about 1.2 Joules/$cm^2$.

13. A method as recited in claim 4 wherein:

the coated monomer is bis(vinylsulfonyl)methane (BVSM).

14. A method as recited in claim 4 wherein:

the coated monomer is bis(vinylsulfonyl)methyl ether (BVSME).

15. An imaging element support comprising:

(a) a polymer support; and (b) a subbing layer coated on said polymer support, said subbing layer a surface including amine reactive groups in a density range of at least $10^{10}$ sites per $cm^2$, the polymer support with the subbing layer thereon having been heat treated at a temperature of from about 50° C. below the glass transition temperature ($T_g$) of the polymeric support up to the glass transition temperature ($T_g$) of the polymeric support the glass transition temperature ($T_g$) of the polymer support.

16. An imaging element support as recited in claim 15 wherein:

the polymer support is nitrogen plasma treated and the subbing layer is a monomer having at least two vinyl sulfone groups.

17. An imaging element support as recited in claim 16 wherein:

the coated monomer is bis(vinylsulfonyl)methane (BVSM).

18. An imaging element support as recited in claim 16 wherein:

the coated monomer is bis(vinylsulfonyl)methyl ether (BVSME).

19. An imaging element support as recited in claim 15 wherein:

the amine reactive group is part of a vinylsulfonyl compound.

20. An imaging element support as recited in claim 15 wherein:

the surface has amine reactive groups in a density range of from $10^{13}$ sites per $cm^2$ to $10^{15}$ sites per $cm^2$.

21. An imaging element including the imaging element support of claim 15.

22. An imaging element including the imaging element support of claim 16.

* * * * *